US011625056B2

(12) United States Patent
Joshi et al.

(10) Patent No.: US 11,625,056 B2
(45) Date of Patent: Apr. 11, 2023

(54) LOW NOISE VOLTAGE REGULATOR

(71) Applicant: Steradian Semiconductors Private Limited, Bengaluru (IN)

(72) Inventors: Alok Prakash Joshi, Bengaluru (IN); Gireesh Rajendran, Bengaluru (IN)

( * ) Notice: Subject to any disclaimer, the term of this patent is extended or adjusted under 35 U.S.C. 154(b) by 0 days.

(21) Appl. No.: 17/390,870

(22) Filed: Jul. 31, 2021

(65) Prior Publication Data

US 2022/0291705 A1 Sep. 15, 2022

(30) Foreign Application Priority Data

Mar. 12, 2021 (IN) ..... 202141010536

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ..... G05F 1/575; G05F 1/59
See application file for complete search history.

(56) References Cited

U.S. PATENT DOCUMENTS

2001/0030530 A1* 10/2001 Marty ..... G05F 1/565 323/280
2014/0097816 A1* 4/2014 Chen ..... G05F 1/575 323/283
2014/0266104 A1* 9/2014 El-Nozahi ..... G05F 1/575 323/280
2016/0077535 A1* 3/2016 Chen ..... G05F 1/56 323/280
2019/0384337 A1* 12/2019 Lu ..... G05F 1/575
2020/0012301 A1* 1/2020 Lee ..... G05F 1/575
2022/0137655 A1* 5/2022 Ray ..... G05F 1/565 323/282

* cited by examiner

*Primary Examiner* — Kyle J Moody
*Assistant Examiner* — Lakaisha Jackson

(57) ABSTRACT

According to an aspect a low noise electronic voltage regulator comprises a regulating transistor operative to regulate an input DC voltage to provide a regulated DC output voltage, an error amplifier configured to generate an error signal based on a reference voltage and a feedback voltage, wherein the error amplifier receiving the feedback voltage through a feedback loop formed between the regulated DC output voltage and the feedback voltage, and a first amplifier in the feedback loop providing a gain of greater than unity from the regulated DC output voltage and the feedback voltage.

8 Claims, 4 Drawing Sheets

LOW NOISE VOLTAGE REGULATOR

BACKGROUND

Cross References to Related Applications

This application claims priority from Indian patent application No.: 202141010536 filed on Mar. 12, 2021 which is incorporated herein in its entirety by reference.

TECHNICAL FIELD

Embodiments of the present disclosure relate generally to low noise electronic system and more specifically to a low noise voltage regulator.

RELATED ART

Voltage regulators are employed to provide a regulated voltage to electronic circuit/systems like phase locked loop and data converters. LDO (Low Drop Out) regulators are a type of regulator that maintains the output voltage constant in conditions of varying input voltage and load. In general, very high expectations are placed on the voltage regulators (LDO) to achieve enhanced performance of the electronic circuits or systems.

Further, voltage regulators introduce noise in to the electronic system. Such noise generated by the voltage regulators often limits the performance of the electronic circuit or system. Thus, beside the voltage regulation performance of a voltage regulator, the noise introduced by the voltage regulator is also required to be reduced to enhance the performance of the electronic circuits. In particular, the noise generated/introduced by the voltage regulator may impede the noise performance of phase locked loop (PLL), frequency synthesizer and data convertors, thereby limiting the throughput of electronic communication systems and accuracy of radar based object detection and tracking systems.

A conventional low noise voltage regulator is depicted in FIG. 1, as is well known, the regulating transistors 110 is operative to provide a constant voltage on port 199. That is, when the input supply voltage on port 101 varies, the transistor 110 absorbs the difference to retain a constant voltage on port 199. The error amplifier 120 is operative to control the voltage drop across the transistor 110 such that, the output voltage is maintained constant. Conventionally for a low drop out, an inverting regulating transistor is used along with a reference low voltage source 170 that is coupled to the inverting terminal and the feedback from the output terminal 199 is provided on the non-inverting terminal of the error amplifier 120. The feedback resistors 130 and 140 operate to provide a fraction of the output terminal voltage. However such conventional configuration suffers from the noise generated by the error amplifier 120, resistors 130 and 140. Thus, such configurations pose strong limitations in implementation of noise sensitive electronic systems.

Another conventional voltage regulator is disclosed in U.S. Pat. No. 7,397,226. As disclosed in that, the feedback gain is increased to maximum (unity) by removing the resistors in the feedback path. Instead, the low voltage reference source value is amplified using an additional amplifier and resistor network to provide a matching reference voltage on the inverting terminal in conjunction with increased feedback voltage value (that is same as the output voltage). The noise generated by the additional amplifier and resistor networks is filtered by a series filter before providing to the inverting terminal of the error amplifier. However, this conventional (prior art) suffers from several limitations such as employing additional amplifier adds to higher area penalty compared to single amplifier regulators. Noise of the error amplifier remain unaddressed, Further, since error amplifiers are usually multi-stage amplifiers, this will add significant noise to the output.

Another conventional voltage regulator is disclosed in U.S. Pat. No. 10,627,844 B1. As disclosed in that, dual error amplifiers and switching circuit are employed. The switching circuit translates the low frequency noise of the error amplifier to a frequency around the switching frequency while down converting high frequency noise into the signal band or low frequencies. Thus reducing the impact of low frequency noise of error amplifier at the output. However this prior art suffers from the limitations such as the switching circuit limits the bandwidth of the amplifier response to a frequency less than half the switching frequency. Further, the high frequency noise of the error amplifier comes as it is at the LDO output. Since error amplifiers are usually multi-stage amplifiers, this will add significant noise to the output.

SUMMARY

According to an aspect a low noise electronic voltage regulator comprises a regulating transistor operative to regulate an input DC voltage to provide a regulated DC output voltage, an error amplifier configured to generate an error signal based on a reference voltage and a feedback voltage, wherein the error amplifier receiving the feedback voltage through a feedback loop formed between the regulated DC output voltage and the feedback voltage, and a first amplifier in the feedback loop providing a gain of greater than unity from the regulated DC output voltage and the feedback voltage.

According to another aspect, the low noise electronic voltage regulator further comprises a second amplifier that is implemented as a replica of the first amplifier, said second amplifier is configured with unity gain to operate as a floating voltage source providing the reference voltage to the error amplifier. In that both the first amplifier and the second amplifier are configured as transconductance amplifier.

According to another aspect the low noise electronic voltage regulator further comprises a reference current source providing a reference current to the second amplifier, wherein the reference current is adjusted to generate a DC output voltage at the second amplifier that is equal in value to the required output voltage of low noise electronic voltage regulator. In that, the first amplifier is a first transistor and the second amplifier is a second transistor that is replica of the first transistor.

According to yet another aspect, a method is provide for regulating an input DC voltage to provide a regulated DC output voltage, the method comprises coupling the input DC voltage and the regulated DC output voltage by a regulating transistor on the source and drain terminal respectively, providing an error signal to the regulating transistor adjusting the voltage drop between the source and drain terminal, generating the error signal from a reference voltage and a feedback voltage and generating the feedback voltage from the regulated DC output voltage with a first gain greater than unity. In that, the reference voltage is generated from a reference current source with a second gain. The first gain and the second gain are transconductance gains, wherein the second gain is equal to unity.

Several aspects are described below, with reference to diagrams. It should be understood that numerous specific details, relationships, and methods are set forth to provide a full understanding of the present disclosure. One who skilled in the relevant art, however, will readily recognize that the present disclosure may be practiced without one or more of the specific details, or with other methods, etc. In other instances, well-known structures or operations are not shown in detail to avoid obscuring the features of the present disclosure.

DETAILED DESCRIPTION OF THE PREFERRED EXAMPLES

Figure 2:
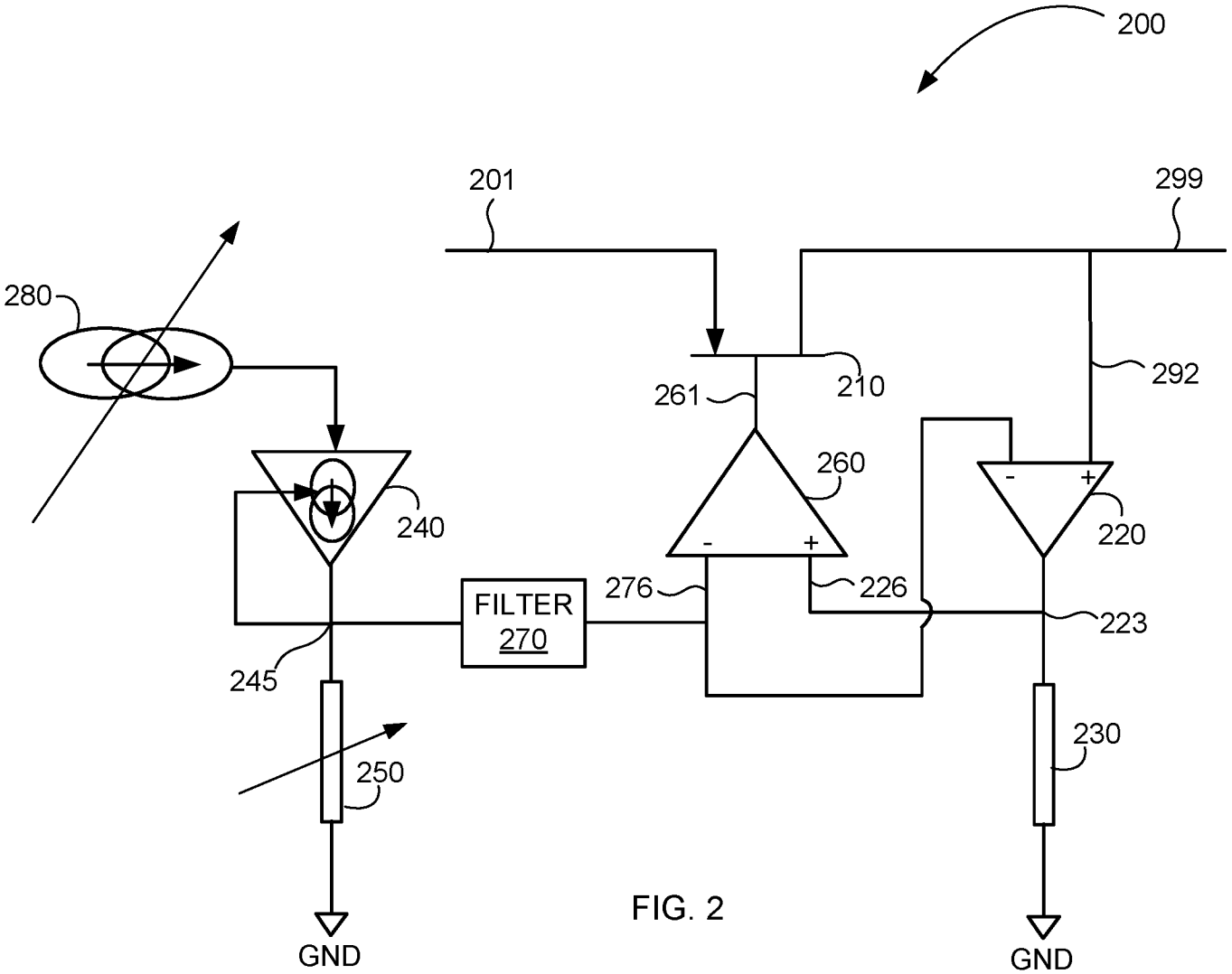
FIG. 2 is a block diagram of an example low voltage regulator in one embodiment.

FIG. 2 is a block diagram of an example low voltage regulator in one embodiment. The low voltage regulator 200 is shown comprising regulation transistor 210, transconductance (gm) amplifier 220, unity gain amplifier 240, resistors 230 and 250, error amplifier 260, filter 270 and reference current source 280. Each element is described in further detail below.

The regulation transistor 210 regulates the voltage on terminal 299 when the input voltage on the terminal 201 varies. That is, the output voltage on terminal 299 (Vo) remains constant when the input voltage on the terminal 201 (Vin) increases/decreases from its expected value. The constant voltage on the output terminal 299 is maintained by varying the voltage across the regulation transistor 210 in accordance with the input voltage 201. Thus voltage $V_T$ across the regulation transistor 210 may be represented as $V_T\uparrow = Vin\uparrow - Vo$. In that, arrow mark representing the changes/variations that follow each other (same change).

The transconductance (gm) amplifier 220 receives feedback voltage on path 292 ($V_{ofb}$) of output voltage Vo (on 299) and converts the feedback voltage $V_{ofb}$ to feedback current ($I_{fb}$) with a gain. The transconductance gain may be represented as "gm". Thus, the $I_{fb}$ may be represented as equal to $gm*V_{ofb}$.

The resistors 230 converts the feedback current $I_{fb}$ to its voltage equivalent. The voltage equivalent on node 223 may be represented as equal to $I_{fb}*Z$, in that, Z representing the impedance (of resister 230) that is acting to convert the $I_{fb}$ to voltage. Thus, voltage on node 223 (denoted as $V_{fb}$) may be represented as equal to $I_{fb}*Z=gm*V_{ofb}*Z=V_{fb}$. The voltage on node 223 is provided as feedback voltage to error amplifier 260.

The transconductance (gm) amplifier 240 and resistor 250 together convert the reference current $I_R$ to a reference voltage $V_R$ on node 245. In that, reference current $I_R$ is received from the reference current source 280. The transconductance (gm) amplifier 240 may be configured as a unity gain amplifier acting as a floating voltage source. The reference voltage on the node 245 is provided to the filter 270 for filtering.

The filter 270 receives the reference voltage $V_R$ and provides a filtered reference voltage $V_{LDO}$ (also referred to as LDO reference voltage) on path 276. The filter 270 may be a low pass filter configured to filter (high frequency) noise generated by the resistor 250 and unity gain amplifier 240. The filter 270 may be implemented as an RC filter for example.

The error amplifier 260 receives the filtered reference voltage on path 276 and feedback voltage on path 226 to generate an error signal on path 261. The error signal drives the transistor 210 such that the voltage drop across the transistor 210 (between two terminal 201 and 299) is changed in conjunction with the change in voltage on 299. The error amplifier may be implemented with a suitable gain to amplify the difference voltage (difference of voltage on its inverting (276) and non inverting (226) terminals.

It may be appreciated that, due to transconductance gain (gm) of the amplifier 220, the noise due to the error amplifier 260 on the output terminal 299 gets attenuated by a factor in proportion to the gain of the transconductance amplifier 220. For example, a "gm" of 1 mS and resistance of 10KΩ will attenuate the noise by 10 times. That is, if the gain of the amplifier 220 is set to a value equal to 10, then the noise due to error amplifier 260 reduces by a factor of 10 compared to the conventional low voltage regulator discussed in the background/related art section above.

Figure 1:
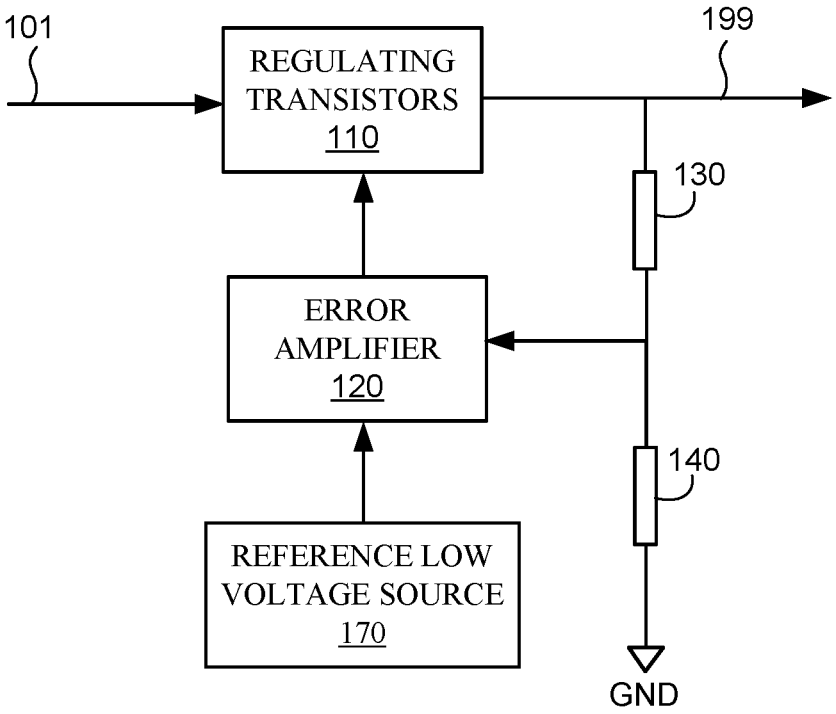
FIG. 1 (Prior Art)
FIG. 1 is a conventional low noise voltage regulator.
Figure 3:
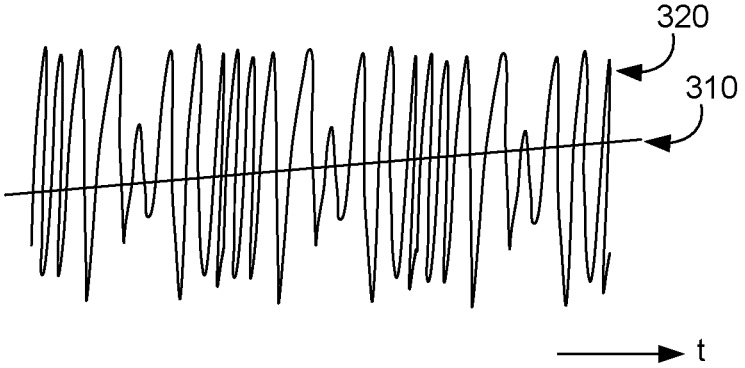
FIG. 3 illustrates an example noise that may be introduced by the amplifier.

In an embodiment, transconductance amplifier 220 may introduce noise in to the feedback loop. FIG. 3 illustrates an example noise that may be introduced by the amplifier 220. As shown the noise of amplifier 220 is shown comprising a low frequency/DC noise 310 and high frequency (AC) noise 320. The DC noise 310 may be due to variations in the operational conditions like transistor threshold variation due to temperature, aging, package stress etc. Similarly, the ac noise 320 may be due to the components thermal noise. The manner in which effect of DC noise 310 at the output 299 is reduced in the low voltage regulator 200 is further described below.

Figure 4:
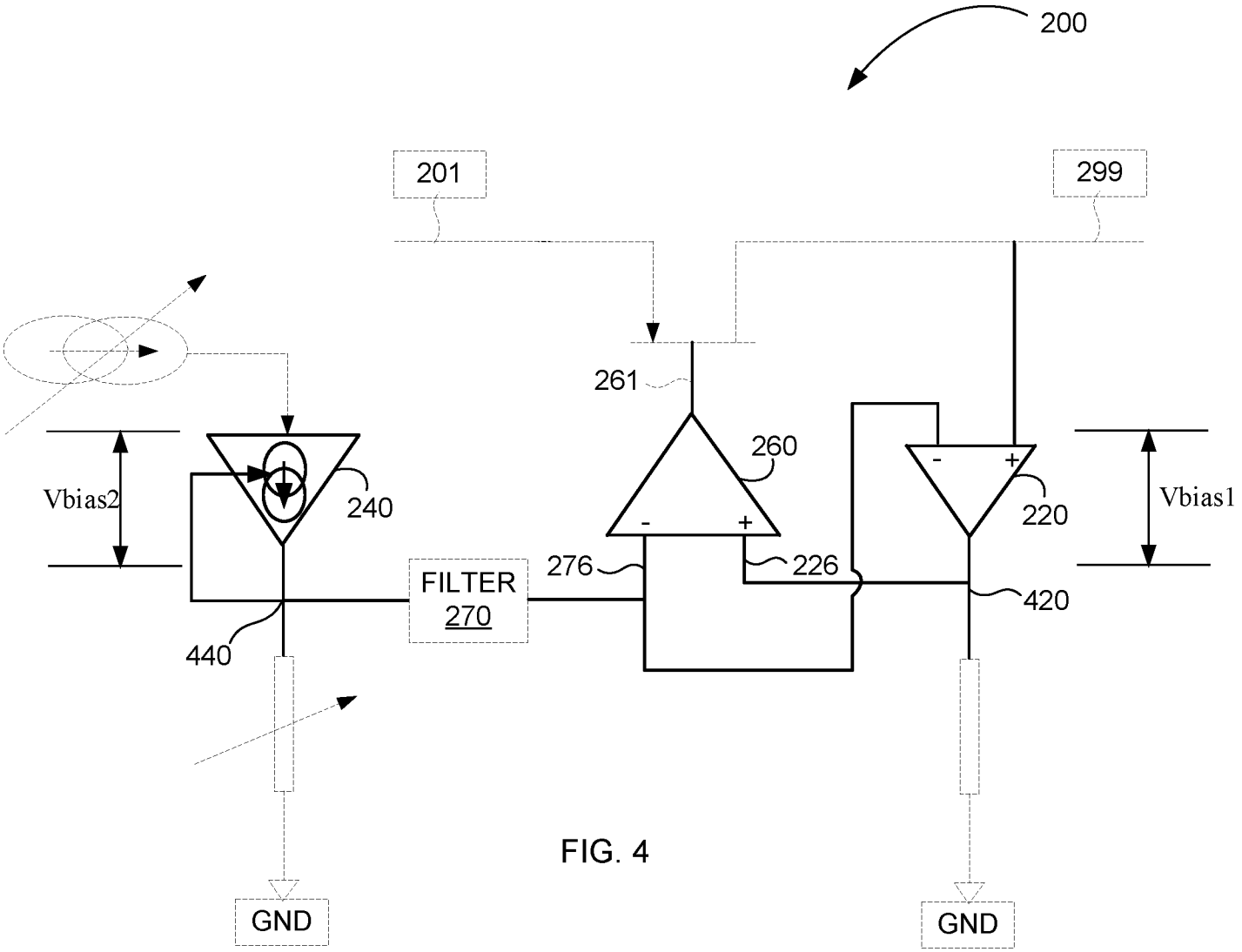
FIG. 4 is a part of the low voltage regulator illustrating the manner in which the effect of DC noise of the amplifier is reduced.

FIG. 4 is a part of the low voltage regulator 200 illustrating the manner in which the effect of DC noise of the amplifier 220 is reduced. In that, the output of the amplifier 220 and 240 are shown coupled to the error amplifier 260 as differential inputs (inverting and non-inverting terminals respectively). In one embodiment, the amplifier 240 is implemented as a replica of the amplifier 220 ("replica"). That means, the two amplifiers 220 and 240 exhibit same DC characteristic and DC bias operating point. For example, the Vbias1 across amplifier 220 is same as the floating voltage Vbias2 across the second amplifier 240. The amplifier 220 is implemented with an AC gain of greater than 1 (for example 10) and the amplifier 240 is implemented with the AC gain of unity.

Due to the "replica" implementation of amplifier 220 and 240, the error amplifier 260 will set the voltage at 299 to be equal to the output voltage of reference current $I_R$. The reference current can be varied by a control loop to compensate any low frequency drift due to temperature or aging of 220. The filter 270 will attenuate the noise from any control loop used to set the reference current $I_R$.

In one embodiment, the effect of AC noise 320 introduced by the amplifier 220 is reduced by implementing the amplifiers 220 (and 240 as it is replica of 220) with fewer components. Due to use of fewer components, the AC noise introduced by the amplifier 220 is reduced. An example implementation of the amplifier 220 and 240 to reduce the AC noise 320 is further described below.

Figure 5:
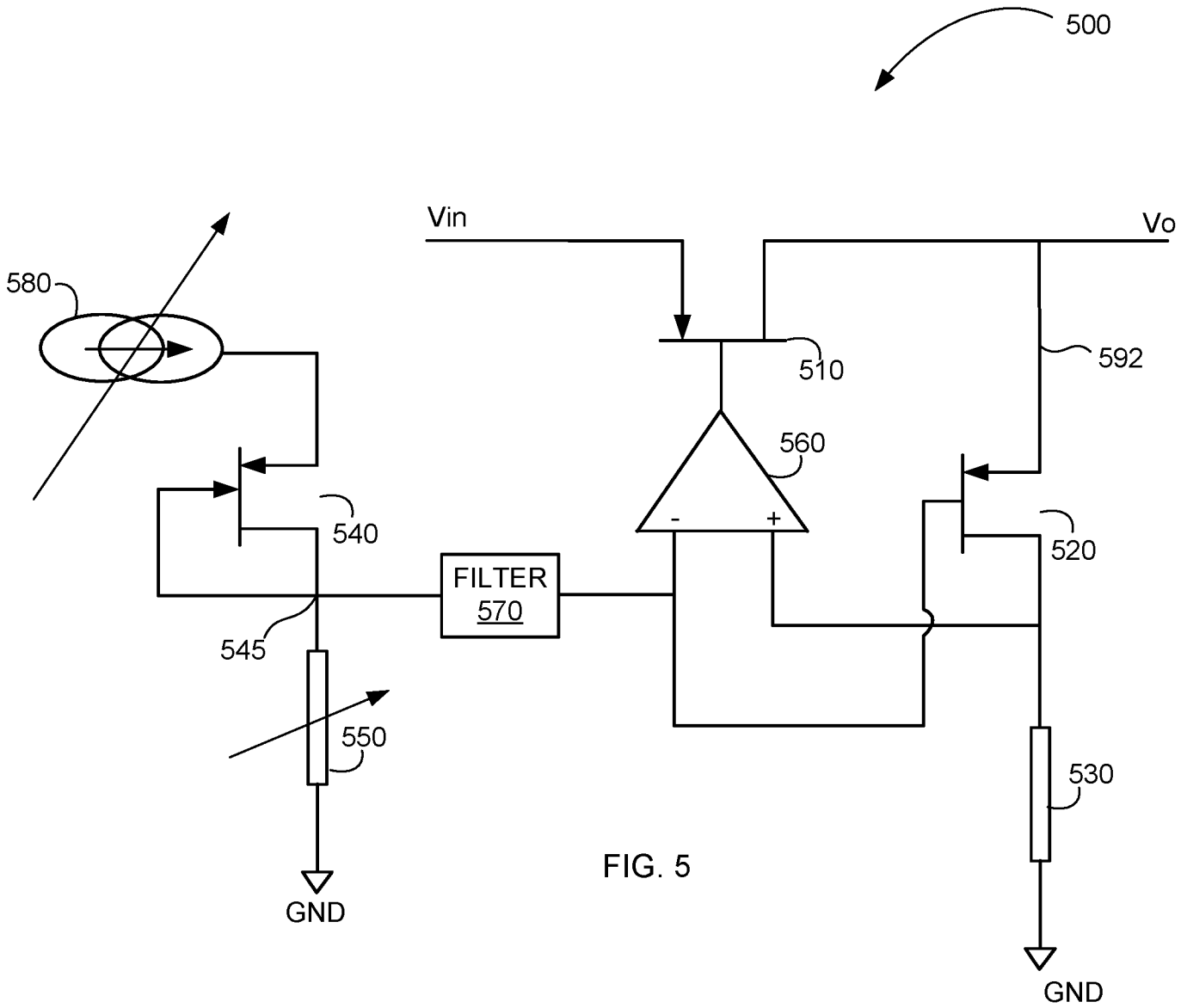
FIG. 5 is a circuit diagram illustrating the manner in which the low voltage regulator may be implemented with fewer components to reduce noise.

FIG. 5 is a circuit diagram illustrating the manner in which the low voltage regulator may be implemented with fewer components to reduce noise. The circuit diagram is shown comprising regulation transistor 510, transistor 520 and 540, resistors 530 and 550, error amplifier 560, filter 570 and reference current source 580. The regulation transistor 510, resistors 530 and 550, error amplifier 560, filter 570 and reference current source 580 are operative to similar to regulation transistor 210 resistors 230 and 250, error amplifier 260, filter 270 and reference current source 280 described above.

The transistor 520 and 540 are configured to operate as amplifier 220 and 240 respectively. Since the amplifier 220 and 240 are implemented with a single transistor 520 and 540, the AC noise 320 generated by the respective transistors (amplifiers) are minimised.

Accordingly, above descriptions provides a method of regulating an input DC voltage to provide a regulated DC output voltage, in which the input DC voltage and the regulated DC output voltage are coupled by a regulating transistor on the source and drain terminal respectively. An error signal is provided to the regulating transistor adjusting the voltage drop between the source and drain terminal. The error signal is generated from a reference voltage and a feedback voltage. The feedback voltage is generated from the regulated DC output voltage with a first gain greater than unity. In that, the reference voltage is generated from a reference current source with a second gain such that the first gain and the second gain are transconductance gains, and the second gain is equal to unity.

While various examples of the present disclosure have been described above, it should be understood that they have been presented by way of example, and not limitation. Thus, the breadth and scope of the present disclosure should not be limited by any of the above described examples, but should be defined in accordance with the following claims and their equivalents.

What is claimed is:

1. A low noise electronic voltage regulator comprising:

a regulating transistor operative to regulate an input DC voltage to provide a regulated DC output voltage;

an error amplifier configured to generate an error signal based on a reference voltage and a feedback voltage, wherein the error amplifier receiving the feedback voltage through a feedback loop formed between the regulated DC output voltage and the feedback voltage; and a first amplifier in the feedback loop providing a gain of greater than unity from the regulated DC output voltage and the feedback voltage.

2. The low noise electronic voltage regulator of claim 1, further comprising a second amplifier that is implemented as a replica of the first amplifier, said second amplifier is configured with unity gain to operate as a floating voltage source providing the reference voltage to the error amplifier.

3. The low noise electronic voltage regulator of claim 2, wherein both the first amplifier and the second amplifier are configured as transconductance amplifier.

4. The low noise electronic voltage regulator of claim 3, further comprising a reference current source providing a reference current to the second amplifier, wherein the reference current is adjusted to set the regulated DC output voltage.

5. The low noise electronic voltage regulator of claim 4, wherein the first amplifier is a first transistor and the second amplifier is a second transistor that is replica of the first transistor.

6. A method of regulating an input DC voltage to provide a regulated DC output voltage comprising:

coupling the input DC voltage and the regulated DC output voltage by a regulating transistor on the source and drain terminal respectively;

providing an error signal to the regulating transistor adjusting the voltage drop between the source and drain terminal;

generating the error signal from a reference voltage and a feedback voltage; and generating the feedback voltage from the regulated DC output voltage with a first gain greater than unity.

7. The method of claim 6, further comprising generating the reference voltage from a reference current source with a second gain.

8. The method of claim 6, wherein the first gain and the second gain are transconductance gains, wherein the second gain is equal to unity.

* * * * *